US006637358B2

(12) United States Patent
Cramer et al.

(10) Patent No.: US 6,637,358 B2
(45) Date of Patent: Oct. 28, 2003

(54) METHOD OF SEWING SUPPLEMENTARY PARTS ON A WORKPIECE

(75) Inventors: Andree Cramer, Detmold (DE); Horst Schlagner, Bielefeld (DE); Frank Hesslich, Leopoldshöhe (DE)

(73) Assignee: Durkoppadler Aktiengesellschaft, Bielefeld (DE)

( * ) Notice: Subject to any disclaimer, the term of this patent is extended or adjusted under 35 U.S.C. 154(b) by 9 days.

(21) Appl. No.: 10/097,318

(22) Filed: Mar. 14, 2002

(65) Prior Publication Data

US 2002/0129753 A1 Sep. 19, 2002

(30) Foreign Application Priority Data

Mar. 15, 2001 (DE) ..... 101 12 474

(51) Int. Cl.[7] ..... D05B 19/12

(52) U.S. Cl. ..... 112/475.02; 112/470.04; 112/475.07; 112/475.08

(58) Field of Search ..... 112/475.02, 475.01, 112/475.07, 475.08, 470.01, 470.03, 470.04, 470.07

(56) References Cited

U.S. PATENT DOCUMENTS

| | | | | |
|---|---|---|---|---|
| 3,701,165 A | * | 10/1972 | Huddleston | 112/475.02 X |
| 5,107,780 A | * | 4/1992 | Braun | 112/470.03 X |

FOREIGN PATENT DOCUMENTS

| | | |
|---|---|---|
| DE | 32 46 027 | 11/1984 |
| DE | 35 90 091 | 4/1986 |
| DE | 39 02 333 | 8/1990 |
| DE | 40 25 103 | 2/1992 |
| WO | WO 00/66825 | 11/2000 |

* cited by examiner

*Primary Examiner*—Peter Nerbun
(74) *Attorney, Agent, or Firm*—Robert F. I. Conte; Barnes & Thornburg

(57) ABSTRACT

In a method of sewing at least one supplementary part on a workpiece, a workpiece identification is fed into a computer and a program is activated thereby, which indicates, on the display screen, the respective supplementary part that is to be sewn on next, and which permits a sewing operation only when the supplementary part is placed on in a correct arrangement and, possibly, in the correct position on the workpiece.

11 Claims, 2 Drawing Sheets

METHOD OF SEWING SUPPLEMENTARY PARTS ON A WORKPIECE

BACKGROUND OF THE INVENTION

1. Field of the Invention

The invention relates to a method of sewing at least one supplementary part on a workpiece by a seam by use of a sewing machine that is drivable by an electric driving motor, which is provided with a computer-equipped control unit and has an external operating switch to be actuated by an operator for triggering a sewing operation.

2. Background Art

WO 00/66 825 teaches a so-called computer-based sewing workstation by means of which to sew sleeve parts into a jacket part in a given method.

DE 40 25 103 A1 discloses to apply, on a workpiece, an identification in the form of a barcode. It further teaches to provide the outer edge of the workpiece with marks in the form of notches that serve to make optically overlap two workpieces that are to be sewn together.

Sewing technology comprises fields of application in which supplementary or small parts that are not articles to be sewn together have to be sewn on a workpiece. For instance, the manufacture of vehicle seat covers requires various supplementary parts to be sewn on at varying distances; these parts may for example be strips of the cross-sectional shape of a hook and of a comparatively soft plastic material the needle of a sewing machine may pass through easily, by means of which to hook and stretch the seat cover or part of the seat cover on to a seat frame. Difficulties reside in keeping the correct sequence of the supplementary parts and joining them to the workpiece at the correct given place.

Furthermore, it is conceivable that only a single supplementary part has to be sewn on a workpiece at a certain place and that varying supplementary parts have to be joined alternately to varying workpieces. This too requires an operator's full concentration, which does of course not go without errors.

SUMMARY OF THE INVENTION

It is an object of the invention to embody a method of the generic type such that during a sewing job, an operator's errors in the selection of supplementary parts are widely precluded.

According to the invention, this object is attained by the following features: input of a workpiece identification that is applied to the workpiece into the computer and activation of a sewing program out of a plurality of sewing programs stored in the computer, with each sewing program including data for allocation of a given supplementary part; insertion of the workpiece into the sewing machine; seizure of the supplementary part by the operator and placement thereof on the workpiece; input of an identification that is applied to the supplementary part into the computer; release of the operating switch in case of conformity, with the data included in the activated sewing program, of the workpiece identification and of the identification of the supplementary part that is to be sewn on by the seam; and production of the seam by the supplementary part being sewn on the workpiece. It is important that the workpiece be identified first and that the supplementary part of the sewn on also be identified in this process. The sewing operation may only start when the operator has added the correct supplementary part and when this has been identified as being the correct part.

The feature which consists in the use of a screen that is allocated to the computer and in imaging, on the screen, the supplementary part to be sewn on the workpiece helps facilitate the operator's job of seizing the correct supplementary part as programmed for an ensuing sewing operation.

In keeping with the advantageous further development which consists in the use of a screen that is allocated to the computer and in imaging the workpiece together with the to-be-sewn-on supplementary part at a place provided therefor on the workpiece, the screen also displays the workpiece together with any supplementary part to be sewn on subsequently.

Various sewing sequences are carried out in further advantageous embodiments.

Details of the invention will become apparent from the ensuing description, taken in conjunction with the drawings.

DESCRIPTION OF THE PREFERRED EMBODIMENT

Figure 1:
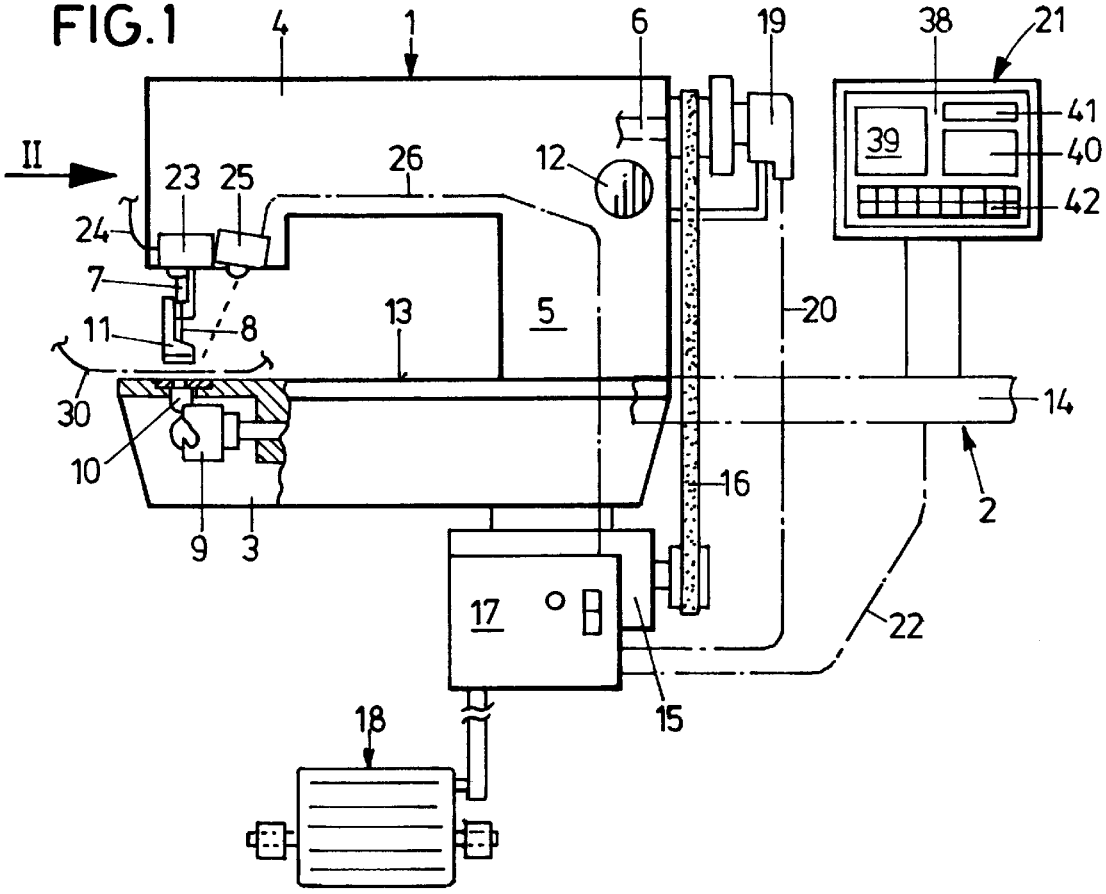
FIG. 1 is an illustration seen from the operator's side of a sewing workstation with a computer.
Figure 2:
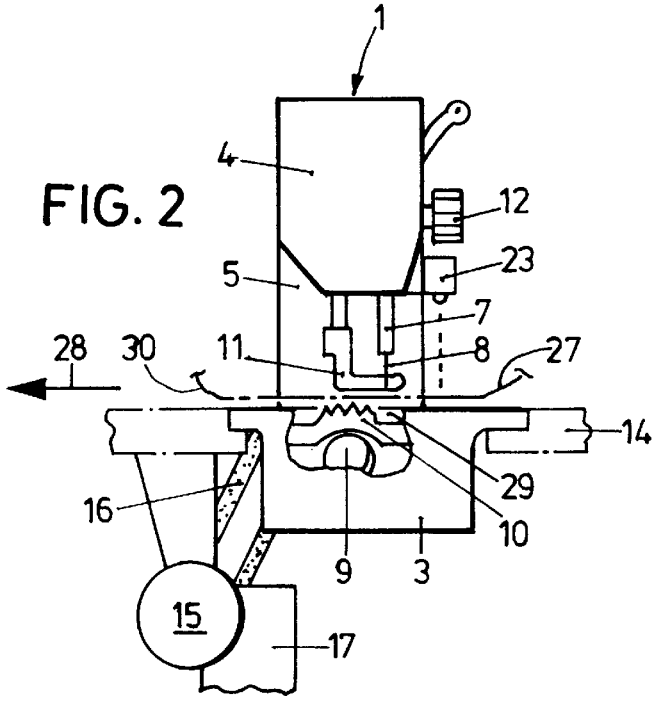
FIG. 2 is an elevation of the sewing workstation in accordance with the arrow II of FIG. 1.

The sewing workstation seen in FIGS. 1 and 2 comprises a sewing machine 1 of conventional design, which is disposed on a stand 2. Customarily, the sewing machine 1 comprises a lower part 3, a so-called base plate, an upper part 4, a so-called arm, and a standard 5 that unites the lower part 3 and the upper part 4 for them to have the overall shape of a C. An arm shaft 6 is rotatably mounted in the upper part 4, serving to drive a needle bar 7 with a needle 8 in reciprocating up and down motion. The arm shaft 6 actuates a hook 9, which is allocated to the needle 8 and lodged in the lower part 3, and also a feeder 10. A presser foot 11 of variable stroke is mounted in the upper part 4 and arranged above the feeder 10. A stitch-length regulator 12 is provided on the upper part 4, serving to set the stitch length of a seam that is to be sewn. The upper side 13 of the lower part 3 is flush with a bearing plate 14 that belongs to the stand 2.

The arm shaft 6 and thus the entire sewing machine 1 are operated via a belt drive 16 by a driving motor 15 that is disposed in the stand 2. For control of the driving motor 15 and thus of the sewing machine 1, a control unit 17 is provided, which is attached to the driving motor 15 and for the operation of which an operating switch 18 is provided in the form of a pedal switch that is to be actuated by the operator. The sewing machine 1 is further equipped with a position transmitter 19 which is coupled with the arm shaft 6 and which, via a line 20, transmits signals to the control unit 17 that represent the position of rotation of the arm shaft 6 at given angular distances. The usual numbers are 512 signals per rotation of the arm shaft 6. The speed of the arm shaft 6 and the respective position of the needle 8 may, among others, be derived from these signals. The sewing machine 1 so far specified is familiar as an industrial sewing automat and used in practice a million times over.

A computer 21 is disposed on the stand 2; it is connected to the control unit 17 via a line 22. Disposed on the sewing-machine upper part 4 is a first sensor 23 which is connected via a line 24 to the computer 21. Provision is made for a second sensor 25 which is connected to the control unit 17 via a line 26. Both sensors 23, 25 are directed to an area 27 which—related to the workpiece conveying direction 28—lies ahead of the place of stitch forming 29 i.e., upstream of the place where the needle 8 passes through a workpiece 30 and forms a stitch. The first sensor 23 serves to detect identifications for instance in the form of a bar code and to pass them on to the computer 21. The second sensor 25 serves to detect marks on workpieces and to transmit corresponding signals to the control unit 17. Functionally, the computer 21 and the control unit 17 cannot be strictly separated from each other because they cooperate for triggering the sewing machine 1.

Figure 3:
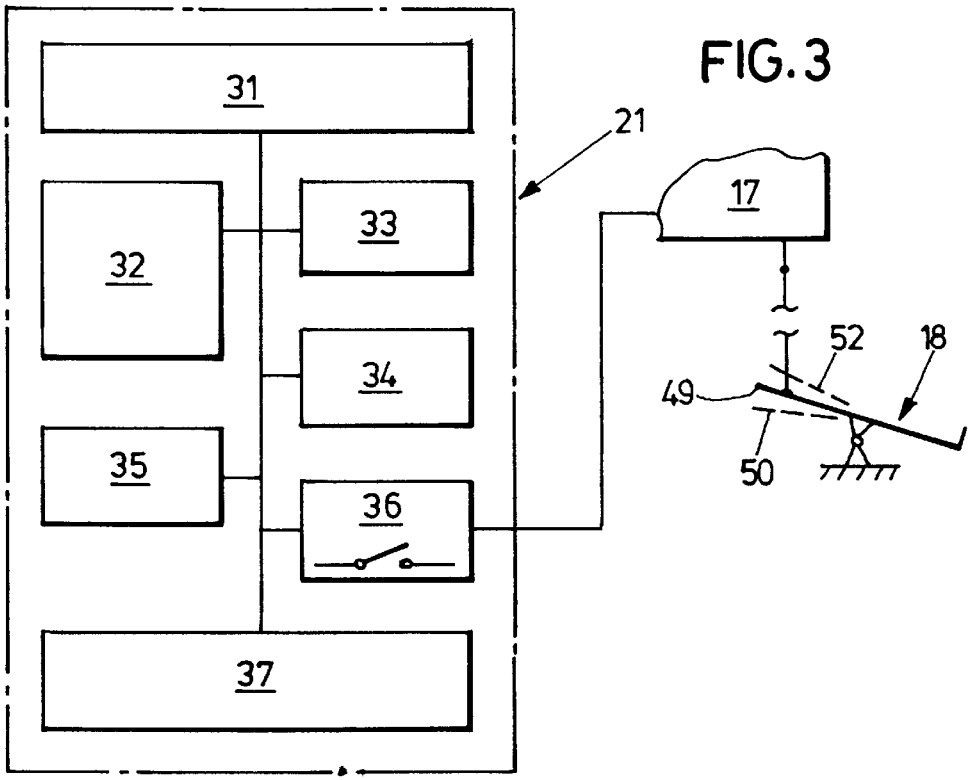
FIG. 3 is a diagram of the data to be stored in the computer of the sewing workstation and of the available installation.

As roughly outline in the diagram of FIG. 3, provision is made, in the computer 21, for a microprocessor 31 with an RAM (random access memory), a CPU (central processing unit) and an HDD (hard disc drive). Provision is further made for a storage device 32 where the data of the workpiece 30 are recorded, inclusive of its identification 33 which is applied to the workpiece 30 for instance in the form of a bar code and which is detected by the first sensor 23. Furthermore, a storage device 34 is provided for sewing parameters such as stitch length, stroke of the presser foot, number of stitches and the like. Moreover, a storage device 35 is provided for supplementary parts that are to be joined on. Further comprises in the computer 21 is a blocking switch 36 which is disposed upstream of the operating switch 18, allowing the sewing machine 1 to be actuated via this operating switch 18 only when data comparison has taken place in the computer 21. Finally, the computer 21 comprises the hard- and software for the screen i.e., the display screen 38, of the computer. Further, the sewing programs for individual seams are recorded in the computer 21 and respectively activated.

Provided on the display screen 38 are a first mapping window 39 for the supplementary part that is to be sewn on next; a second mapping window 40 picturing the correct position of a supplementary part ahead of the place of stitch forming 29, a data display window 41; and an operating keyboard 42 in the form of a so-called tough screen.

Figure 4:
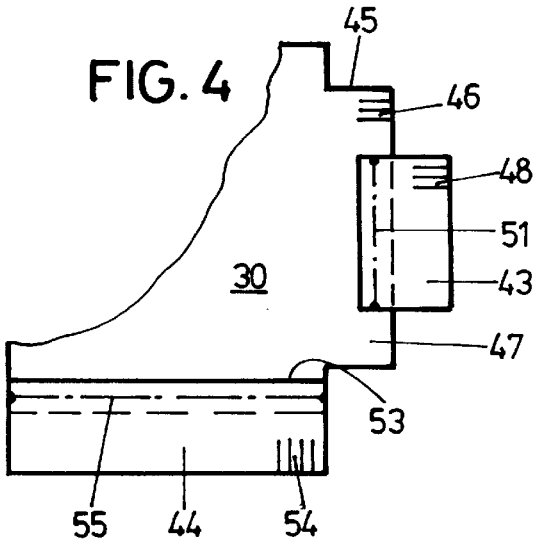
FIG. 4 is an illustration of a workpiece with supplementary parts that are to be sewn on individually.
Figure 5:
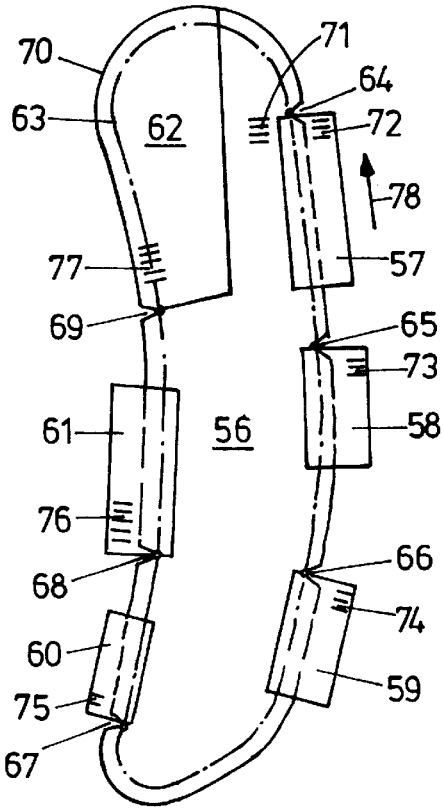
FIG. 5 is an illustration of a workpiece with supplementary parts to be joined on all around and with a second workpiece to be sewn on additionally.

The mode of operation is explained, taken in conjunction with FIGS. 4 and 5:

FIG. 4 illustrates the simplest of cases, namely supplementary parts 43, 44 which are to be sewn on certain places given by the pattern of the workpiece 30. At the starting point 45, the workpiece 30 has an identification 46 in the form of a bar code. Reading this identification 46 into the computer 21 takes place by the first sensor 23. In this way, the sewing program is activated that is to be carried out on this workpiece 30. The sewing program being activated, the first supplementary part 43 is displayed on the first mapping window 39 of the display screen 38. The second mapping window 40 shows how and where to sew the supplementary part 43 on the workpiece 30 in the corresponding area 47. In this case, the supplementary part 43 only has to be sewn on in this area 47 and not at a precisely given place. Aided by the picture of the supplementary part that corresponds to the sewing program, the operator selects the supplementary part 43 from a corresponding container and joins it on. The supplementary part 43 again comprises an identification 48 in the form of a bar code. The operator places the supplementary part 43 on the workpiece 30 in the area 47 corresponding to a position that is indicated on the second mapping window 40; the workpiece 30 and the supplementary part 43 have been oriented on the bearing plate 14 in such a way that the identification 48 of the supplementary part 43 is in front of the place of stitch forming 29. The first sensor 23 detects the identification 48 and, in the case of program conformity, releases the operating switch 18 via the blocking switch 36. The operator may now press the operating switch 18 from its zero position 49 shown in a solid line in FIG. 3 into the position of forward sewing 50 outlined by dashes so that a seam 51 is sewn. At the end of the seam 51, the operator stops the sewing operation and actuates the operating switch 18 in the reverse direction into its position of thread cutting 52 equally shown by dashes in FIG. 3, which triggers a thread cutting operation.

This calls up a second sewing sequence that is recorded in the activated sewing program i.e., the second supplementary part 44 is pictured on the first mapping window 39 and the second mapping window 40 shows how to sew it on in the area 53—seen at the bottom of FIG. 4—of the workpiece 30. The operator seizes the supplementary part 44 and applies it in the correct way. The first sensor 23 takes up the identification 54 of the supplementary part 44 and releases the sewing operation via the blocking switch 36 in the case of program conformity so that this supplementary part 44 may be sewn on by a seam 55 in the area 53 of the workpiece 30. Termination of the sewing operation takes place as described above.

FIG. 5 illustrates a workpiece 56 on which to sew five supplementary parts 57, 58, 59, 60, 61 and an additional workpiece 62. Therefore, a continuous allround seam 63 is sewn for reasons of efficiency, in the course of which the supplementary parts 57 to 61 and the additional workpiece 62 are sewn on. The workpiece 56 has a total of six marks 64, 65, 66, 67, 68, 69 in the form of notches in the other edge 70 of the workpiece 56. The marks 64 to 68 define the point where one of the supplementary parts 57 to 61 has to be put on. The mark 69 indicates where the additional workpiece 62 has to be put on. The identification 71 of the workpiece 56, the identifications 72 to 76 of the supplementary parts 57 to 61 and the identification 77 of the additional workpiece 62 are recorded in the storage 32.

Sewing starts in such a way that the workpiece 56 is placed on the bearing plate 14 by its first mark 64 in front of the place of stitch forming 29 so that the first sensor 23 may read the identification 71 and transmit it to the computer 21. The second sensor 25 detect the first mark 64. The detection of the identification 71 activates the associated stored sewing program in the computer 21, calling up, and picturing on the first mapping window 39, the first supplementary part 57 for the first sewing sequence. In the same way, the orientation and arrangement thereof on the workpiece 56 is shown by the second mapping window 40. The operator takes the first supplementary part 57 from a corresponding stock and applies in this way to the first mark 64. The first sensor 23 reads the identification 72 thereof into the computer. By corresponding data verification and in the case of program conformity, the blocking switch 36 is closed so that the operator may trigger the sewing operation in the manner described above by actuation of the operating switch 18. The production of the seam 63 starts, with the workpiece 56 together with the first supplementary part 57 being moved in the workpiece conveying direction 78 which is also called the sewing direction in practice. The sewing operation continues as far as to the second mark 65 where the sewing machine 1 is stopped by this second mark 65 being detected by the second sensor 25. By means of the operating keyboard 42, the operator now calls up the following sewing sequence on the display screen 38. Depending on how the computer 21 is programmed, this may also happen automatically. The first mapping window 39 now pictures the second supplementary 58 and the second mapping window 40 shown the position and arrangement thereof on the workpiece 56. Again, the second supplementary 58 is applied to the associated second mark 65. Actuation of the operating switch 18 continues the production of the seam. This is repeated until the third, fourth and fifth supplementary parts 59 to 61 have been sewn on the workpiece, starting from the associated third, fourth and fifth marks 66 to 68. The sewing operation is again stopped at the last mark 69; triggered by the operator or in accordance with the sewing sequence stored in the computer 21, the additional workpiece 62 is now pictured on the first mapping window 39 and its arrangement on the workpiece 56 is shown by the second mapping window 40. The operator puts the second workpiece 62 in a position on the mark 69. Once the identification 77 of the additional workpiece 62 has been read in and corresponding data comparison has taken place in the computer 21, the blocking switch 36 is again closed so that the sewing process may be continued until the second workpiece 62 has been sewn on, which means as far as to the first mark 64 in this case. Once the sewing machine 1 is stopped, a thread-cutting job, and possibly a back stitching job, takes place by the operating switch 18 being correspondingly switch into its position 52.

Sewing the allround seam 63 is reasonable, given the short period of working, whenever a number of closely side by side supplementary parts 57 to 61 have to sewn on the workpiece 56. But fundamentally—as seen in the exemplary embodiment of FIG. 4—sewing on supplementary parts 43, 44 can be made by individual seams 51, 55 in a given sewing sequence.

Inputting the identifications of the respective workpiece and the respective supplementary part may take place not only automatically by the first sensor 23 reading them in, but also manually on the operating keyboard 42 prior to the start of a sewing segment.

The marks 64 to 69 are notches in the workpiece 56 in the example of embodiment shown; however, they may also be small, projecting flags. They are embodied on the workpiece 56.

What is claimed is:

1. A method of sewing at least one supplementary part (43, 44; 57 to 61) on a workpiece (30; 56) by a seam (51, 55; 63) by use of a sewing machine (1) that is drivable by an electric driving motor (15), which is provided with a computer-equipped control unit (17) and has an external operating switch (18) to be actuated by an operator for triggering a sewing operation, comprising the following steps:

a) input of a workpiece identification (46; 71) that is applied to the workpiece (30; 56) into the computer (21) and activation of a sewing program out of a plurality of sewing programs stored in the computer (21), with each sewing program including data for allocation of a given supplementary part (43, 44; 57 to 61);

b) insertion of the workpiece (30; 56) into the sewing machine (1);

c) seizure of the supplementary part (43, 44; 57 to 61) by the operator and placement thereof on the workpiece (30; 56);

d) input of an identification (48, 54; 72 to 76) that is applied to the supplementary part (43, 44; 57 to 61) into the computer (21);

e) release of the operating switch (18) in case of conformity, with the data included in the activated sewing program, of the workpiece identification (46; 71) and of the identification of the supplementary part (43, 44; 57 to 61) that is to be sewn on by the seam (51, 55; 63); and f) production of the seam (51, 55; 63) by the supplementary part (43, 44; 57 to 61) being sewn on the workpiece (30; 56).

2. A method according to claim 1, comprising use of a screen (38) that is allocated to the computer (21) and imaging, on the screen (38), the supplementary part (43, 44; 57 to 61) to be sewn on the workpiece (30; 56).

3. A method according to claim 1, comprising use of a screen (38) that is allocated to the computer (21) and imaging the workpiece (30;56) together with the to-be-sewn-on supplementary part (43, 44; 57 to 61) at a place provided therefor on the workpiece (30; 56).

4. A method according to claim 1, wherein several varying supplementary parts (43, 44; 57 to 61) are successively sewn on a workpiece (30; 56) at given places.

5. A method according to claim 1, wherein at least one supplementary part (57 to 61) is applied to a mark (64 to 68) of the workpiece (56).

6. A method according to claim 5, wherein the mark (64 to 68) is detected and fed into the control unit (17), whereby an ensuing sewing sequence is activated.

7. A method according to claim 1, wherein the workpiece (30; 56) is provided with a machine readable workpiece identification (46; 71); and wherein the workpiece identification (46; 71) is read into the computer (21) upon insertion of the workpiece (30; 56) into the sewing machine (1).

8. A method according to claim 1, wherein supplementary parts (43, 44; 57 to 61) are provided with a machine readable identification (48, 54; 72 to 76); and wherein this identification (48, 54; 72 to 76) is read into the computer (21) upon insertion of the workpiece (30; 56) into the sewing machine (1).

9. A method according to claim 7, wherein the workpiece identification (46; 71) is a bar code.

10. A method according to claim 8, wherein the identification (48, 54; 72 to 76) of the at least one supplementary part (43, 44; 57 to 61) is a bar code.

11. A method according to claim 5, wherein the at least one mark (64 to 68) is a notch or a projecting flag of the workpiece (56).

* * * * *